US006758473B2

(12) United States Patent
Seelig et al.

(10) Patent No.: US 6,758,473 B2
(45) Date of Patent: Jul. 6, 2004

(54) GAMING DEVICE AND METHOD

(75) Inventors: Jerald C. Seelig, Absecon, NJ (US); Lawrence M. Henshaw, Hammonton, NJ (US)

(73) Assignee: Atlantic City Coin & Slot Service Company, Inc., Pleasantville, NJ (US)

( * ) Notice: Subject to any disclaimer, the term of this patent is extended or adjusted under 35 U.S.C. 154(b) by 0 days.

(21) Appl. No.: 10/245,525

(22) Filed: Sep. 16, 2002

(65) Prior Publication Data

US 2004/0051239 A1 Mar. 18, 2004

(51) Int. Cl.[7] ..... A63F 9/00; G07F 17/34

(52) U.S. Cl. ..... 273/143 R; 273/138.2; 463/20; 463/46; 463/22

(58) Field of Search ..... 273/143 R, 138.2; 463/20, 46, 22

(56) References Cited

U.S. PATENT DOCUMENTS

| | | | | |
|---|---|---|---|---|
| 5,560,603 | A | 10/1996 | Seelig et al. | |
| 5,584,763 | A | 12/1996 | Kelly et al. | |
| 5,664,998 | A | 9/1997 | Seelig et al. | |
| 5,779,544 | A | 7/1998 | Seelig et al. | |
| 5,848,932 | A | 12/1998 | Adams | |
| 5,882,261 | A * | 3/1999 | Adams | 463/20 |
| 5,947,820 | A | 9/1999 | Morro et al. | |
| 5,976,015 | A | 11/1999 | Seelig et al. | |
| 5,997,400 | A | 12/1999 | Seelig et al. | |
| 6,068,553 | A | 5/2000 | Parker | |
| 6,142,873 | A | 11/2000 | Weiss et al. | |
| 6,165,070 | A | 12/2000 | Nolte et al. | |
| 6,190,254 | B1 | 2/2001 | Bennett | |
| 6,224,483 | B1 | 5/2001 | Mayeroff | |
| 6,305,686 | B1 | 10/2001 | Perrie et al. | |
| 6,328,649 | B1 | 12/2001 | Randall et al. | |
| 6,336,863 | B1 | 1/2002 | Baerlocher et al. | |
| 6,338,678 | B1 | 1/2002 | Seelig et al. | |
| 6,340,158 | B2 | 1/2002 | Pierce et al. | |
| 6,346,043 | B1 | 2/2002 | Colin et al. | |
| 6,394,902 | B1 | 5/2002 | Glavich et al. | |
| 6,398,219 | B1 | 6/2002 | Pierce et al. | |
| 6,406,369 | B1 | 6/2002 | Baerlocher et al. | |

OTHER PUBLICATIONS

"Empire", AC Coin & Slot Service Company, advertizement, IGWB vol. 19, No. 5, May 1998, p. 21.*
"Isle of Pearls", AC Coin & Slot Service Company, brochure, World Congress & Gaming Expo, Oct. 14, 1997.*
"Little Green Men Jr.", AC Coin & Slot, brochure, World Congress & Gaming Expo, Oct. 1, 2001.*

* cited by examiner

*Primary Examiner*—Benjamin H. Layno
(74) *Attorney, Agent, or Firm*—Ian F. Burns

(57) ABSTRACT

A gaming device comprising a gaming apparatus configured to allow a player to place a wager and play a game and a bonus display configured to indicate a bonus prize to be awarded to the player. One embodiment of the gaming device comprises at least one game reel having a plurality of game symbols. At least one symbol on the game reel may indicate a game outcome. The gaming device also comprises at least one bonus position reel having a plurality of bonus position symbols. The bonus position reel does not have gaming symbols and does not display the outcome of the game. The bonus position symbol displayed by the bonus position reel changes the bonus display in a predetermined relationship.

23 Claims, 3 Drawing Sheets

GAMING DEVICE AND METHOD

CROSS REFERENCES TO RELATED APPLICATIONS

None

FIELD OF INVENTION

The present invention relates to gaming devices and, more particularly, to a gaming device and method having a bonus reel that causes a bonus indicator to move.

BACKGROUND

Gaming devices are well known in the art and a large variety of gaming devices have been developed. In general, gaming devices allow users or players to play a game. In many casino-type gaming devices, the outcome of the game depends, at least in part, on a randomly generated event. For example, a gaming device may use a random number generator to generate a random or pseudo-random number. The random number may then be compared to a predefined table to determine the outcome of the event. If the random number falls within a certain range of numbers on the table, the player may win a predefined prize. The table may also contain display information that allows the gaming device to generate a display that corresponds to the outcome of the game. The gaming device may present the outcome of the game on a large variety of display devices, such as mechanical spinning reels or video screens.

Some gaming devices award bonus prizes in addition to prizes that are awarded in the primary game. A bonus prize is generally defined as an additional prize that is awarded to the player when a predefined event occurs. An example of a bonus game can be found in U.S. Pat. No. 5,848,932 issued to Adams. One of the gaming devices described in this document has a primary game having three spinning game reels and a bonus game having a bonus display with one spinning wheel. When predetermined indicia are displayed on the spinning game reels of the primary game, the wheel of the bonus display can be activated to indicate a bonus prize. The bonus prize is awarded in addition to any prizes awarded in the primary game.

Another example of a bonus game can be found in U.S. Pat. No. 6,336,863 issued to Baerlocher et al., which discloses a slot machine with a bonus award display. Baerlocher's bonus award display is a bonus wheel, and Baerlocher's bonus selector is a mechanical, movable pointer.

One problem associated with gaming devices disclosed in Adams and Baerlocher et al. is that they do not include a bonus reel that does not determine the primary game outcome but may be associated with the bonus game outcome. Such bonus reel may easily catch players' attention, as players may perceive the bonus reel as another opportunity to play a game or another opportunity to win money in addition to the opportunities offered by the primary game and the bonus game. Once players are attracted to the gaming device, they tend to play longer because the display device enhances the stimulation and excitement experienced by players. When this occurs, the gaming devices having the attractive feature become more commercially successful relative to other gaming devices.

Another problem with the gaming devices in Adams and Baerlocher et al. is that their indicators are not animated. Animated indicators are more desirable than non-animated indicators, as they appeal more to the players.

Yet another problem with Adams and Baerlocher et al. is that once a bonus event occurs, a bonus game outcome or a bonus prize is almost readily determined. When a bonus game is triggered, a bonus award is selected, displayed, and immediately awarded to the player. The conventional bonus game is reset, and the player resumes playing the primary game. It is desirable to add intermediate steps between the occurrence of the bonus event and the awarding of the bonus prize to add additional an element of surprise and excitement for the players. It is further desired that the intermediate steps involve spinning a bonus reel that may determine the bonus game outcome.

In addition to the problems of conventional bonus games discussed above, including those of Adams and Baerlocher et al., conventional bonus games have short game or play duration. For example, when a bonus event occurs in conventional bonus games, a bonus wheel is rotated to determine a bonus prize, which is almost awarded immediately to the player. The conventional bonus game is then reset, and the player resumes playing the primary game. A bonus game with longer duration than conventional bonus games and with more sequence of attractive and entertaining events is desired.

Conventional bonus games further have limited opportunities for players to earn bonus prizes. It is desirable for bonus games to provide more opportunities for players to earn bonus prizes and not just a single shot at a bonus wheel. It is further desirable for bonus games to allow players to accumulate more bonus prizes.

In view of the foregoing, there is a need in the art for a gaming apparatus that provides a highly attractive and entertaining device for displaying bonus prizes, a bonus reel, an animated indicator, an additional element of surprise and excitement, a bonus game with longer duration, a bonus game with more sequence of attractive and entertaining events, and more opportunities to earn bonus prizes than conventional bonus games.

SUMMARY

Advantages

The various embodiments of the present invention may, but do not necessarily, achieve one or more of the following advantages:

- provide a highly attractive and entertaining device for displaying bonus prizes;
- provide a gaming device with a bonus position reel that is not used to communicate the outcome of the game;
- provide a gaming device with bonus reel, the bonus reel displaying how a bonus indicator will be moved;
- provide an additional element of surprise and excitement to conventional bonus games; and provide more opportunities to earn bonus prizes; and
- the ability to encourage players to play a gaming device longer.

These and other advantages of the present invention may be realized by reference to the remaining portions of the specification, claims, and abstract.

BRIEF DESCRIPTION OF CERTAIN ASPECTS OF THE INVENTION

The present invention provides a gaming apparatus having a gaming device configured to allow a player to place a wager and play a game and a bonus display configured to indicate a bonus prize to be awarded to the player. One embodiment of the gaming device comprises at least one game reel having a plurality of game symbols. At least one symbol on the game reel may indicate a game outcome. The gaming device also comprises at least one bonus position reel having a plurality of bonus position symbols. The bonus position reel does not have gaming symbols and does not display the outcome of the game. The bonus position symbol displayed by the bonus position reel changes the bonus display in a predetermined relationship.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

Preferred embodiments of the present invention are shown in the accompanying drawings wherein.

DESCRIPTION OF THE PREFERRED EMBODIMENTS

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
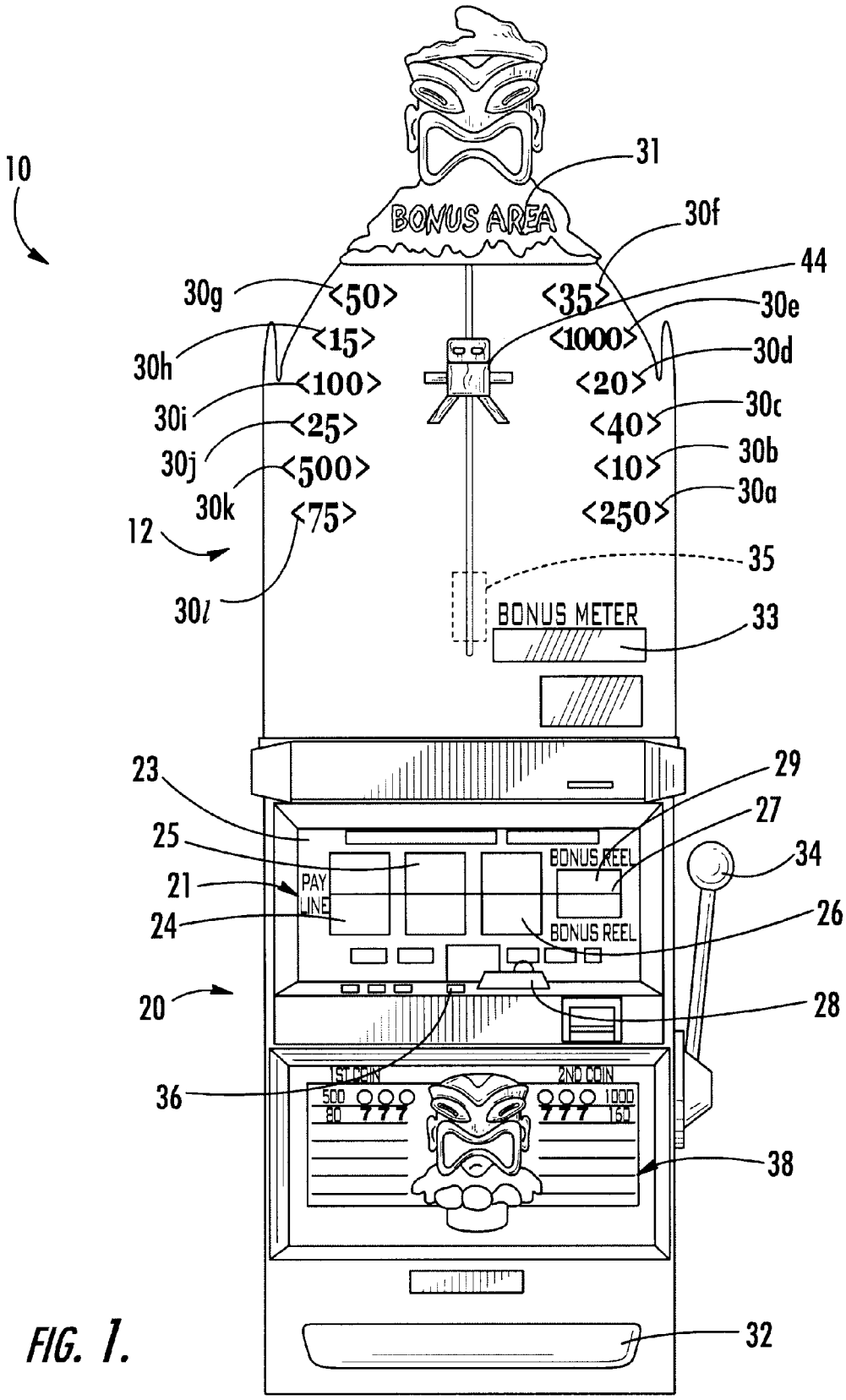
FIG. 1 is substantially a front view of the gaming device of the present invention.

As seen in FIG. 1, the present invention comprises a gaming device, generally indicated by reference number 10. In one preferred embodiment, gaming device 10 comprises a bonus display 12 and a game apparatus 20. Game apparatus 20 may be any of a large number of devices that are adapted to allow players to play a game. In a preferred embodiment, game apparatus 20 is a slot machine that allows a player to place a wager and play a game. Game apparatus 20 may include a wager acceptor for accepting wagers, such as a coin slot 28 or card reader (not shown). In addition, a payout mechanism (not shown) and a coin receptacle 32 may be provided for awarding prizes or for dispensing wagers to players cashing out. In addition, a printer and dispenser may be provided for dispensing vouchers to players. A handle 34 and button 36 are provided for activating game apparatus 20 to begin a game. A pay table 38 may further be provided to allow a player to see what symbol or combination of symbols provides a winning event. In at least one preferred embodiment, game apparatus 20 may be an S Plus model gaming device manufactured by International Game Technology in Reno, Nev.

Game apparatus 20 may further include a gaming outcome display 21 preferably positioned in front of game apparatus 20 to face a player. Game outcome display 21 may utilize physical game reels 24, 25, and 26. Game reels 24, 25, and 26 are rotatably attached to game apparatus 20 and a drive mechanism, e.g. stepper motors, (not shown) may be provided for rotating the reels in a manner well known in the art. Each game reel 24, 25, and 26 preferably has a plurality of symbols (not shown) positioned on the circumference of each game reel 24, 25, and 26. Game reels 24, 25, and 26 are positioned side-by-side with a portion of their individual circumferences facing the front of game apparatus 20. A panel 23 preferably covers game reels 24, 25, and 26 such that only a portion of their individual circumferences are shown to the player. At least one symbol from any of game reels 22, 24, or 26 may be used to display or communicate a game outcome. At least one pay line 27 may be provided for the player to determine a game outcome based on the symbol or a combination of symbols positioned thereon. In an alternative embodiment, gaming outcome display 21 utilizes a video display (not shown) displaying images of game symbols.

In the most preferred embodiment, game apparatus 20 further includes at least one bonus reel 29 that is not used to indicate the outcome of the game. Bonus reel 29 may be a physical reel or an image of a reel generated by a video device (not shown). In the physical reel embodiment, bonus reel 29 may also be rotatably attached to game apparatus 20 and a drive mechanism (not shown) is provided for rotating the reel. Bonus reel 29 and game reels 24, 25, and 26 are preferably positioned side-by-side as that their axes of rotation are coincident and a portion of their individual circumferences is visible to the player. Panel 23 also covers bonus reel 29 such that only a portion of its circumference is shown to the player. Additionally, in the most preferred embodiment, the size of bonus reel circumference covered by flat panel 23 varies from the size of game reel circumference covered by flat panel 23 to differentiate bonus reel 29 from game reels 24, 25, and 26. Other methods of differentiating bonus reel 29 from game reels 24, 25, and 26 may also be used. A pay line 27 may be provide to indicate the symbols displayed by game reels 24, 25, and 26 and bonus reel 29.

Bonus reel 29 also includes at least one bonus position symbols (not shown) positioned on its circumference. In the most preferred embodiment, bonus reel 29 does not comprise game symbols and it is not used to indicate the outcome of the primary game. Rather, bonus reel 29 comprises at least one bonus position symbol that is used to indicate how the position of a bonus indicator 44 within display device 12 will be changed. For example, bonus positions symbols may be in the form of advance amounts, such as "3 spaces," "6 spaces," "9 spaces," and so forth. Of course, bonus position symbols are not limited to these forms. When bonus reel 29 spins, and "3 spaces" symbol is positioned parallel to pay line 27, indicator 44 will be advanced by three spaces or stop positions within bonus display 12.

Bonus display 12 preferably has a plurality of stop positions 30*a-l*, and each position 30*a-l* may be associated with at least one predetermined bonus prize. Alternatively, one or more positions may not be associated with a bonus prize. Most preferably, the plurality of stop positions 30*a-f* or 30*g-l* is arranged sequentially starting from a starting position 35 to an ending position 31. Starting position 35 is preferably located on the bottom of display device 12, and ending position 31 (also referred to as top position) is preferably located on top of display device 12. Intermediate to starting position 35 and ending position 31 may be a predetermined number of intermediate positions or levels. For instance, 12 intermediate positions are shown in FIG. 1.

When a bonus-activating event occurs, indicator 44 is made to move within bonus display 12 according to the bonus position symbol displayed by bonus reel 29. Indicator 44 may be stopped at any of the positions 30*a-l*, thereby possibly indicating a bonus prize to be awarded to the player. Each position 30 may further include blinking lights or electrical components that would indicate the bonus prize to be awarded. The bonus prize to be awarded to a player may further be displayed on a meter 33, which may comprise a light emitting diode display.

The bonus prize may be determined by a random number generator (not shown) and a virtual pay table as described in U.S. Pat. No. 5,823,874, issued to Adams, which is hereby incorporated by reference. An example of a simple pay table may appear as follows:

TABLE 1

| Random Number | Amount Paid |
|---|---|
| 0.00 to 0.50 | $10.00 |
| 0.51 to 0.75 | $50.00 |
| 0.76 to 0.95 | $1,000.00 |
| 0.96 to 1.00 | $10,000.00 |

For example, if random number generator produced 0.65, $50.00 would be awarded to the player. Bonus reel 29 may be activated to display a bonus position symbol, such as "2 spaces," which then causes indicator 44 to stop at position 30*g*, which indicates bonus prize of $50.00. If the random number generator produced 0.80, the player would be awarded $1,000. Bonus reel 29 may be activated to display a bonus position symbol, such as "5 spaces," which then causes indicator 44 to stop at position 30*e*, which indicates a bonus prize of $1,000.00.

The bonus selection process may be repeated to accumulate several bonus prizes that are added to form the award to the game player. The bonus selection process can be repeated a predetermined number of times. For example, the bonus game could be repeated three times to accumulate an award. The present invention is not limited to the example pay table shown. Furthermore, different kinds of bonus prizes, besides monetary prizes, may be awarded. For example, the bonus prizes may be goods, services, or additional games. Furthermore, progressive prizes, randomly determined prizes, and multipliers may also be awarded.

In an alternative embodiment, only a top position 31 is associated with a bonus prize, and thus indicator 44 must be advanced to top position 31 to award a prize. The plurality of stop positions 30*a-l* indicates a progress of a player's bonus play or the player's progress in reaching top position 31. The symbols on bonus reel 29 may advance indicator 44 a predefined number of positions. For example, if bonus reel 29 display indicates the "2 spaces", the bonus indicator may advance two positions towards top position 31. Once indicator 44 reaches top position 31, the prize is awarded to the player. Indicator 44 may then be returned to a starting position. In this embodiment, the player must accumulate the bonus position symbols to win a bonus prize. The bonus prize may be randomly selected from a set of predetermined prizes when bonus indicator 44 reaches top position 31. This selection process may be conducted preferably using the random number generator and the virtual pay table described above. The various possible prizes may be displayed on the bonus display (not shown). When one of the prizes is selected, the selected prize may further be flashed, highlighted, or otherwise indicated as the selected prize.

Indicator 44 is preferably an animated three-dimensional indicator positioned within bonus display 12. For example, indicator 44 shown in FIG. 1 is an image of a tiki. The number, shapes, designs, and placements of indicator 44 may vary. Various designs of bonus display 12 with varying numbers and amounts of bonus prizes 30 may be utilized and still fall within the scope of the present invention.

Figure 2:
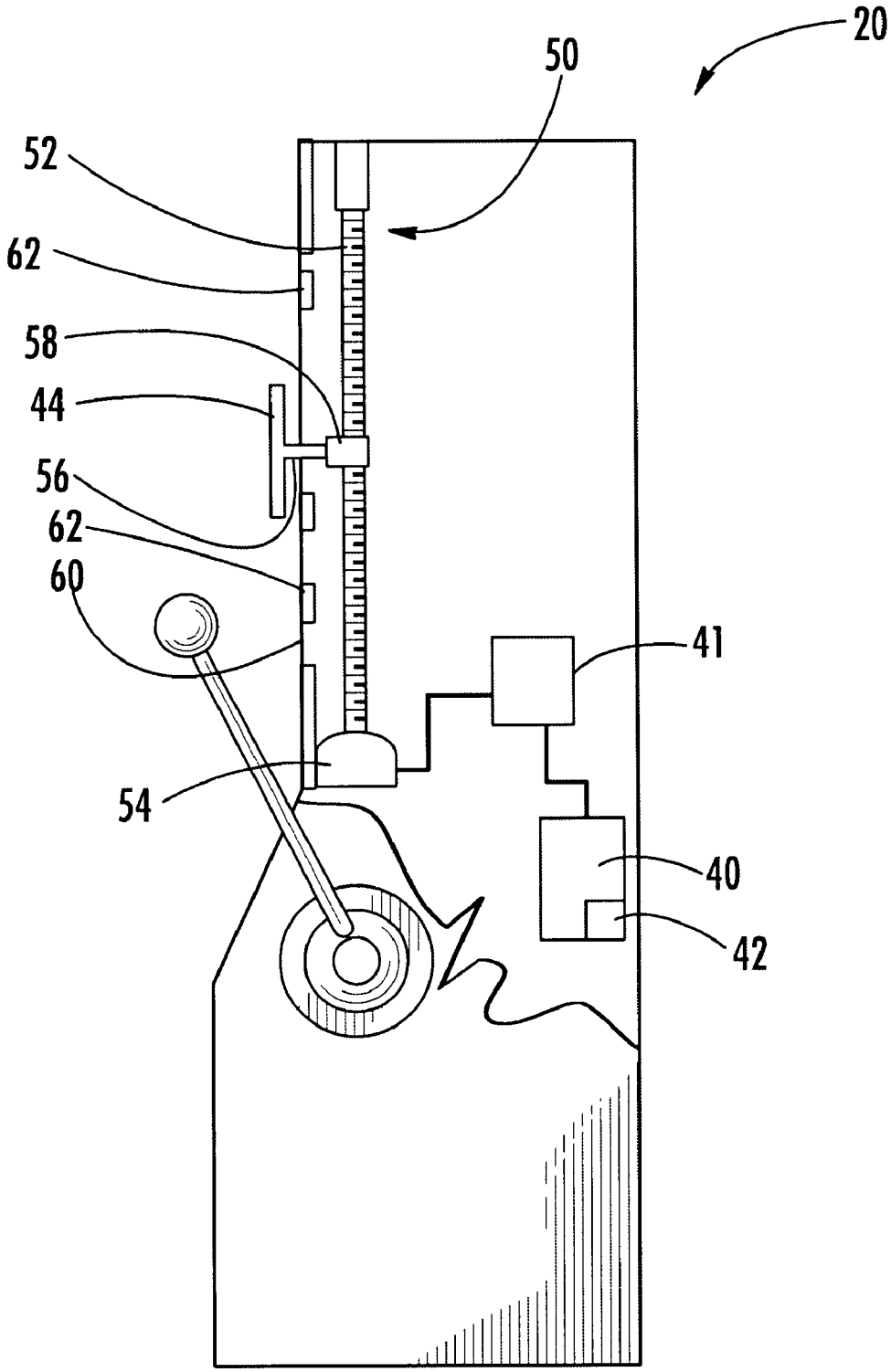
FIG. 2 is substantially a partial cross-sectional view of the gaming device of FIG. 1.

Referring now to FIG. 2, game apparatus 20 is preferably controlled by an electronic controller 40 that utilizes a random number generator 42. Random number generator 42 produces a random or pseudo random number for each game. The outcome of the game may be determined by comparing the random number to a table of outcomes stored in a memory and accessed by controller 40. A number of different tables of outcomes may be used and different tables may be used for different games. The tables can be designed so that different prizes have different probabilities of being awarded. Such design techniques are well known in gaming and are described above. Examples of such designs are shown in U.S. Pat. No. 4,448,419, issued to Telnaes, and U.S. Pat. No. 5,456,465, issued to Durham, which are hereby incorporated by reference. Controller 40 causes gaming outcome display 21 (FIG. 1), or game reels 24, 25, 26, to display or communicate the outcome of the game that corresponds to the outcome of random number generator 42. It is recognized that game apparatus 20 may operate in many other ways and still achieve the objects of the present invention.

Game apparatus 20 may also be capable, via controller 40 or other bonus control mechanism (not shown), of producing a bonus-activating event. This event may be many different types of events. For example, a bonus-activating event may comprise a game outcome such as displaying a particular symbol, e.g., a "bonus" symbol, or combination of symbols, such as three "7" symbols on reels 24, 25, and 26. If the game being played is poker based, the bonus-activating event may be an occurrence of a certain hand, such as a royal flush. Furthermore, a bonus-activating event may occur when a player accumulates a number of symbols or game outcomes over a number of separate game plays. For example, a bonus-activating event may occur when the player receives three "bonus" symbols during a period of time. The bonus-activating event may be based on an external event. For example, a bonus-activating event may occur when a group of players obtain a certain result. Sensors may be provided external to gaming device 10 (not shown) to detect external bonus-activating events.

In the most preferred embodiment, a bonus-qualifying event occurs when a bonus-qualifying symbol (not shown) is presented on game reels 24, 25, or 26 (FIG. 1). In the preferred embodiment, at least two different bonus-qualifying symbols may be provided on game reels 24, 25, or 26. The first bonus-qualifying symbol is preferably an advance position symbol that indicates that the player has qualified to activate the bonus reel 29. A second bonus-qualifying symbol (not shown) that may be provided on game reels 24, 25, or 26 indicates that a play has immediately qualified to win a bonus. This may be called an "instant win" symbol. After this symbol is displayed, indicator 44 immediately moves to a position that indicates the player has won a bonus prize. Unlike the advance position symbol, the award of a prize from the instant win symbol is preferably not contingent upon the position of indicator 44 or the player's progress in reaching top position 31 (not shown in FIG. 2). One or more sensors (not shown) may be provided for determining if a bonus-qualifying event has occurred. For example, sensors may sense the positions of reels 24, 25, or 26. When reels generate bonus-qualifying symbols, gaming device controller 40 would sense this position and trigger bonus reel 29 (FIG. 1).

In another embodiment, bonus game controller 41 (see FIG. 2) may be provided to detect when a bonus-activating event occurs in game apparatus 20. This may be accomplished by gaming device controller 40 transmitting a signal to the bonus game controller 41 that a bonus event has occurred. For example, gaming device controller 40 may determine the outcome of each game, and when a bonus-activating outcome occurs, it transmits a signal to the bonus game controller 41. Alternatively, the bonus game controller 41 may periodically interrogate gaming device controller 42.

FIG. 2 further shows indicator 44, which is made to move up and down by a drive mechanism 50. The drive mechanism may be a large variety of different devices. For example, as shown in FIG. 2, drive mechanism 50 may be a vertically positioned worm gear 52 that is caused to rotate by a stepper motor 54. Indicator 44 may be attached to worm gear 52 by a bracket 56 that is attached to a nut 58 rotatably attached on worm gear 52. A slot 60 may be provided in the front face of bonus display 12, which allows bracket 56 to pass through the face. Sensors 62 may be provided to allow controller 40, or other bonus control mechanism (not shown), to detect the position of indicator 44. While indicator 44 was shown to move vertically, it may also be moved horizontally, or diagonally or in a non-linear fashion, such as in a rotating manner or zigzag manner.

In another embodiment, a wheel (not shown) may be attached to stepper motor 54. Periphery of wheel has at least one notch detectable by a sensor (not shown) and used by the bonus game controller 41 or game controller 40 to monitor the position of moveable indicator 44. Wheel and worm gear 52 may be rotated together by stepper motor 54. The sensor monitors the position of moveable indicator 44 by detecting the notch and storing the number of times the sensor has detected the notch in a memory of bonus game controller 41 or game controller 40. Bonus game controller 41 or game controller 40 may further store information pertaining to a predetermined number of times the sensor has detected the notch and the corresponding predetermined position of moveable indicator 44. An optical interrupt (not shown) may be provided to reset the indicator position information. Sensor may be an infrared source and detector. In alternative embodiments, periphery of wheel may comprise portions with different reflective characteristics, such as physical holes or gaps or absorbent paint lines.

Once indicator 44 has stopped, bonus display 12 may display the player's progress in reaching top position 31. Bonus display 12 may also display the bonus prize won by the player. For instance, the bonus prize to be awarded may blink or have some other indication of selection. The bonus prize to be awarded may further be displayed on meter 33. Other effects may also be presented, such as pre-recorded sound from speakers. If the actual bonus prize is money, the amount of the bonus prize may be added to the player's credit meter (not shown) or the bonus prize may be dispensed from dispenser 70, coin dispenser 32, or a voucher printer (not shown).

Figure 3:
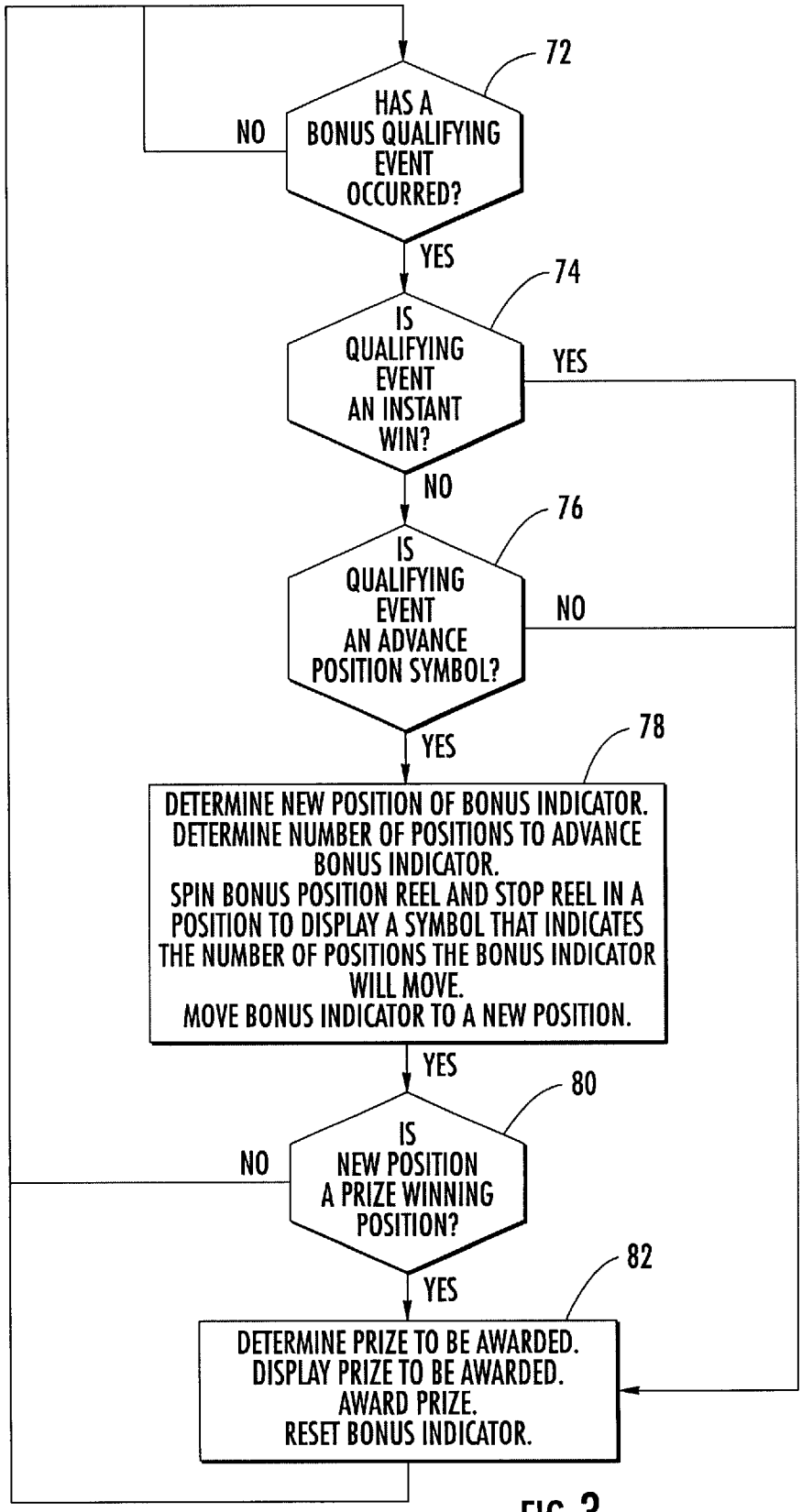
FIG. 3 is substantially a schematic diagram of a preferred gaming method of the present invention.

Referring now to FIG. 3, a preferred gaming method is shown wherein a controller described above (not shown in FIG. 3) detects occurrence of a bonus-qualifying event at step 72. Once a bonus-qualifying event occurs, at step 74, the controller determines whether bonus-qualifying event is an instant win event. If the bonus-qualifying event is an instant win event, step 82 is executed, and controller determines the prize to be awarded. The controller further causes the indicator to indicate the prize and awards the prize. Controller then resets the bonus indicator.

If the bonus-qualifying event is not an instant win event, step 76 is executed where the controller determines whether the bonus-qualifying event is an advance position symbol event. If the bonus-qualifying event is not an advance position symbol event, then the controller executes step 82 discussed above. If the bonus-qualifying event is an advance position symbol event, then step 78 is executed where: the new position of bonus indicator is determined; the number of positions required to advance the bonus indicator is determined; bonus position reel is spun and stopped in a position to display a symbol that indicates the number of positions the bonus indicator will move; and bonus indicator advances according to the bonus position symbol.

After step 78, the controller determines whether the new position is a prize-winning position at step 80. If the new position is a prize-winning position, then the controller executes step 82 discussed above. If the new position is not a prize-winning position, the method loops back to step 72 where the controller awaits to detect a bonus-qualifying event.

Conclusion

It can thus be realized that certain embodiments of the present invention provide a highly attractive and entertaining device for displaying bonus prizes. In one embodiment, a moveable animated indicator is provided to indicate a bonus prize. The game may allow the indicator to indicate a plurality of bonus prizes. In an alternative embodiment, a moveable animated indicator is provided to indicate a player's progress toward achieving a top prize. This feature encourages players to play longer on a gaming apparatus, as players have a tendency to continue playing once they have made some progress towards the top prize.

Certain embodiments of the present invention further provide a bonus reel positioned within a gaming device. In one embodiment, the bonus reel has the capability of causing a bonus indicator positioned within a bonus display to move within the bonus display. This embodiment provides intermediate steps between a bonus-qualifying event and determination of a bonus prize. For example, the bonus reel has to be spun to see if and how many steps the indicator would advance. Alternatively, bonus reel has to be spun to see if an instant win symbol may be displayed on the bonus reel. Therefore, certain embodiments of the present invention provide an additional element of surprise and excitement to players.

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

What is claimed is:

1. A gaming apparatus, comprising:

(A) a gaming device, the gaming device being configured to allow a player to place a wager and play a game, the gaming device comprising:

(a) at least one game reel, the reel having a plurality of game symbols, wherein an outcome of the game is indicated by displaying at least one symbol to the player; and (b) at least one bonus position reel, separate from the at least one game reel, the bonus position reel having a plurality of bonus position symbols indicating changes in the position of a bonus display, the bonus position symbols not having game symbols, wherein the bonus position reel is not used to display the outcome of the game; and (B) a bonus display, the bonus display being configured to indicate a bonus prize to be awarded to the player, wherein the bonus display is adapted to change position in a predetermined relationship corresponding to the bonus position symbol displayed by the bonus position reel.

2. The gaming apparatus of claim 1, wherein the bonus position reel is adapted to display a bonus position symbol when a bonus-qualifying event occurs.

3. The gaming apparatus of claim 2, wherein the bonus-qualifying event occurs when the game reel displays a bonus-qualifying symbol.

4. The gaming apparatus of claim 1, wherein the bonus display comprises at least one moveable bonus indicator, wherein the moveable bonus indicator is configured to change its position when the bonus position reel displays a bonus symbol.

5. The gaming apparatus of claim 4, wherein the moveable bonus indicator is configured to move from a starting position to an ending position, the starting position and the ending position being separated by a predetermined number of intermediate positions, wherein ending position indicates that the player has won a predefined bonus prize, wherein the bonus symbols indicate the number of positions that the bonus indicator advances towards the ending position.

6. The gaming apparatus of claim 4, wherein the bonus display comprises a plurality of stop positions, the moveable bonus indicator being adapted to stop in each of the stop positions, each stop position being associated with a bonus prize, wherein the bonus symbols indicate the number of positions that the bonus indicator moves.

7. The gaming apparatus of claim 4, wherein the moveable bonus indicator is configured to move in a substantially straight line.

8. The game apparatus of claim 7, wherein the straight line is substantially vertical.

9. The game apparatus of claim 7, further comprising a plurality of bonus symbols, wherein the bonus symbols are positioned adjacent to the straight line.

10. The game apparatus of claim 7, wherein the bonus prize positions are positioned adjacent to the straight line.

11. The game apparatus of claim 10, wherein the straight line is substantially horizontal.

12. The game apparatus of claim 10, wherein the straight line is substantially diagonal.

13. The game apparatus of claim 4, wherein the moveable bonus indicator is configured to move in a zigzag line.

14. The game apparatus of claim 7, wherein the straight line is substantially horizontal.

15. The game apparatus of claim 7, wherein the straight line is substantially diagonal.

16. A method of playing a game, the method comprising:

(A) providing at least one game reel, the gaming reel having a plurality of game symbols;

(B) providing at least one bonus position reel separate from the at lease one game reel the bonus position reel having a plurality of bonus position symbols indicating changes in the position of a bonus indicator;

(C) providing at least one bonus display, the bonus display comprising a moveable bonus indicator adapted to indicate a bonus prize to be awarded to a player, wherein the bonus prize may be positioned in a plurality of positions;

(D) causing the game reel to display at least one game symbol, the game symbol being used to indicate the outcome of the game;

(E) causing a bonus-qualifying event to occur;

(F) causing the bonus position reel to display at least one bonus position symbol; and (G) causing the bonus indicator to change position in a predetermined relationship corresponding to the bonus position symbol displayed by the bonus position reel.

17. The method of claim 16, wherein the bonus-qualifying event comprises displaying a bonus-qualifying symbol on the game reel.

18. The method of claim 17, wherein the bonus display comprises a plurality of sequential positions, wherein the predetermined relationship comprises advancing the bonus indicator a predetermined number of the sequential positions.

19. The method of claim 16, wherein at least one of the positions is associated with a prize, and further comprising awarding the prize to the player when the bonus indicator is placed in the position associated with the prize.

20. A gaming apparatus, comprising:

(A) game means having a game display for displaying an outcome of a game;

(B) indicating means separate from the game display for indicating one of a plurality of bonus prizes to be awarded to a player, wherein each bonus prize is associated with a position;

(C) position symbol means for displaying a bonus position symbol used to indicate how the position of the bonus indicating means will be changed, the means for displaying a bonus position symbol not being used to display the outcome of the game; and (D) position means for changing the position of the indicating means in a predetermined relationship corresponding to the position symbol displayed by the position symbol means.

21. The gaming apparatus of claim 20, wherein the indicating means is configured to move in a substantially straight line.

22. The game apparatus of claim 21, wherein the straight line is substantially vertical.

23. The game apparatus of claim 20, wherein the indicating means is configured to move in a zigzag line.

* * * * *